US012778287B2

(12) United States Patent
Wang et al.

(10) Patent No.: US 12,778,287 B2
(45) Date of Patent: Nov. 3, 2026

(54) WORKSTATION

(71) Applicant: Steelcase Inc., Grand Rapids, MI (US)

(72) Inventors: Liang Wang, Hong Kong (CN); Sa Liu, Dong Guan (CN)

(73) Assignee: Steelcase Inc., Grand Rapids, MI (US)

( * ) Notice: Subject to any disclaimer, the term of this patent is extended or adjusted under 35 U.S.C. 154(b) by 120 days.

(21) Appl. No.: 18/884,823

(22) Filed: Sep. 13, 2024

(65) Prior Publication Data

US 2025/0009126 A1 Jan. 9, 2025

Related U.S. Application Data

(63) Continuation of application No. PCT/CN2022/082226, filed on Mar. 22, 2022.

(51) Int. Cl.

| | |
|---|---|
| ***A47B 87/00*** | (2006.01) |
| ***A47B 13/00*** | (2006.01) |
| ***A47B 21/02*** | (2006.01) |

(52) U.S. Cl.

CPC ..... *A47B 87/002* (2013.01); *A47B 13/003* (2013.01); *A47B 21/02* (2013.01)

(58) Field of Classification Search

CPC ..... A47B 87/002; A47B 13/003; A47B 21/02; A47B 5/06; A47B 11/00

See application file for complete search history.

(56) References Cited

U.S. PATENT DOCUMENTS

| | | | | |
|---|---|---|---|---|
| 2,414,433 A | | 1/1947 | Bargen | |
| 2,468,473 A | | 4/1949 | Underwood | |
| 3,351,405 A | | 11/1967 | Ferdinand et al. | |
| 3,986,780 A | | 10/1976 | Nivet | |
| 4,035,097 A | | 7/1977 | Bachand | |
| 4,161,303 A | | 7/1979 | Bachand | |
| 4,612,863 A | * | 9/1986 | Vonhausen | A47B 21/03 108/50.01 |

(Continued)

FOREIGN PATENT DOCUMENTS

| | | |
|---|---|---|
| BR | 202012018709 | 10/2013 |
| CN | 3730482 C1 | 6/1989 |

(Continued)

OTHER PUBLICATIONS

International Search Report and Written Opinion for International Application No. PCT/CN2022/082226 mailed Nov. 30, 2022 (7 pages).

*Primary Examiner* — Daniel J Rohrhoff
(74) *Attorney, Agent, or Firm* — Benesch Friedlander Coplan & Aronoff LLP

(57) ABSTRACT

A workstation includes an understructure and a primary worksurface supported by the understructure. The primary worksurface is located at a first height adapted to accommodate a seated user positioned adjacent to and facing the front edge. A support extends upwardly from the primary worksurface. An auxiliary worksurface is coupled to the support and is vertically spaced from the primary worksurface. The auxiliary worksurface is pivotable relative the primary worksurface between a use position and a stored position. The auxiliary worksurface is located at a second height adapted to accommodate a standing user positioned adjacent to and facing the first edge when the auxiliary worksurface is in the use position.

23 Claims, 16 Drawing Sheets

(56) References Cited

U.S. PATENT DOCUMENTS

| | | | | |
|---|---|---|---|---|
| 5,547,270 | A | 8/1996 | Dang | |
| 5,562,049 | A | 10/1996 | Hoffman et al. | |
| 5,673,632 | A | 10/1997 | Sykes | |
| D401,440 | S | 11/1998 | Brandenberg | |
| 6,213,191 | B1 | 4/2001 | Nitzsche | |
| 6,491,268 | B1 | 12/2002 | Channer et al. | |
| 6,568,335 | B2 | 5/2003 | Hamilton et al. | |
| 7,481,170 | B2 | 1/2009 | Sommerfield | |
| 7,677,182 | B2 | 3/2010 | Mueller et al. | |
| 7,798,070 | B2 * | 9/2010 | Ooba | A47B 21/00 108/50.01 |
| 8,947,215 | B2 | 2/2015 | Mandel et al. | |
| 9,839,285 | B2 | 12/2017 | Cassamajor | |
| 9,961,992 | B2 * | 5/2018 | King | F16M 11/18 |
| 9,980,559 | B2 | 5/2018 | Randolph et al. | |
| 10,051,956 | B2 | 8/2018 | Burgess et al. | |
| 10,405,647 | B2 * | 9/2019 | Laudadio | F16M 11/045 |
| 10,517,392 | B2 | 12/2019 | Abraham et al. | |
| 11,116,312 | B2 | 9/2021 | Battey et al. | |
| 11,877,649 | B1 * | 1/2024 | Addington | A47B 13/088 |
| 2005/0022702 | A1 * | 2/2005 | Hunter | A47B 11/00 108/139 |
| 2010/0126394 | A1 * | 5/2010 | Burak | A47B 83/001 108/186 |
| 2010/0288168 | A1 | 11/2010 | Rheault et al. | |
| 2011/0090410 | A1 | 4/2011 | Ye | |
| 2016/0143431 | A1 | 5/2016 | Lee | |
| 2016/0213145 | A1 * | 7/2016 | Johnson | A47B 83/001 |
| 2017/0086581 | A1 * | 3/2017 | Gammon | A47B 87/005 |
| 2017/0245638 | A1 * | 8/2017 | Caratiola | A47B 17/065 |
| 2018/0295982 | A1 * | 10/2018 | Yamamoto | A47B 9/00 |
| 2021/0106133 | A1 * | 4/2021 | Anderson | A47B 9/20 |
| 2021/0219712 | A1 * | 7/2021 | Gold | B25H 1/12 |
| 2022/0386771 | A1 * | 12/2022 | Glöckl | A47B 21/02 |
| 2024/0148135 | A1 * | 5/2024 | Aube | A47B 9/18 |

FOREIGN PATENT DOCUMENTS

| | | | |
|---|---|---|---|
| CN | 4106947 | A1 | 9/1991 |
| CN | 4112180 | A1 | 10/1992 |
| CN | 105077987 | A | 11/2015 |
| CN | 204812680 | U | 12/2015 |
| CN | 105686378 | A | 6/2016 |
| DE | 102004028725 | A1 | 12/2005 |
| DE | 10 2012 109 589 | B4 | 10/2019 |
| EP | 1 952 720 | A1 | 8/2008 |
| EP | 2 755 525 | B1 | 7/2014 |
| FR | 2773963 | A1 | 7/1999 |
| GB | 186104 | A | 9/1922 |
| GB | 2542196 | A | 3/2017 |
| JP | 4621005 | B2 | 11/2010 |
| JP | 5958953 | B2 | 7/2016 |
| JP | 6248264 | B1 | 12/2017 |
| WO | 2007202527 | A1 | 12/2007 |
| WO | WO 2021/094016 | A1 | 5/2021 |

* cited by examiner

WORKSTATION

RELATED APPLICATION

This application is a continuation of International Patent Application No. PCT/CN2022/082226, filed Mar. 22, 2022, entitled WORKSTATION, the entire disclosure of which is hereby incorporated herein by reference.

FIELD OF THE INVENTION

The present application relates generally to a workstation, and in particular to a workstation with primary and auxiliary worksurfaces positioned to accommodate users in sit/stand work modes, together with methods for the use and assembly thereof

BACKGROUND

Workstations may be configured for users situated at seated heights or standing heights. In some configurations, the height of the workstation may be adjusted between the seated and standing height. Such height adjustable systems, however, may require expensive actuators and controls, access to power, and frequent maintenance. In addition, the systems may be difficult to operate. In addition, workstations are often assembled from a variety of different parts and accessories, thereby requiring extensive and/or specialized installation, and maintenance of a large inventory of disparate components. Such systems are often difficult to reconfigure.

SUMMARY

The present invention is defined by the following claims, and nothing in this section should be considered to be a limitation on those claims.

In one aspect, one embodiment of a workstation includes an understructure and a primary worksurface supported by the understructure. The primary worksurface includes a front edge, a rear edge and opposite ends, wherein the front and rear edges are spaced apart in a first direction and wherein the ends are spaced apart in a second direction orthogonal to the first direction. The primary worksurface is located at a first height adapted to accommodate a seated user positioned adjacent to and facing the front edge. A support extends upwardly from the primary worksurface at a location closer to the front edge than the rear edge. An auxiliary worksurface is coupled to the support and is vertically spaced from the primary worksurface, wherein the auxiliary worksurface comprises a first edge spaced apart from a second edge and a length. The auxiliary worksurface is pivotable relative the primary worksurface between a use position, wherein the first edge extends in the second direction and wherein at least a portion of the first edge overlies the front edge of the primary worksurface, and a stored position, wherein the first edge extends in the first direction, wherein the auxiliary worksurface is located at a second height adapted to accommodate a standing user positioned adjacent to and facing the first edge when the auxiliary worksurface is in the use position.

In another embodiment, a workstation includes an understructure having "n1" leg assemblies spaced apart in a second direction and "n2" pairs of beams extending in the second direction and connecting the leg assemblies, wherein n2=n1−1. The workstation also includes "n3" primary worksurfaces supported by the understructure, wherein n3=2×n2.

Each primary worksurface includes a front edge, a rear edge and opposite ends, wherein the front and rear edges are spaced apart in a first direction orthogonal to the second direction, and wherein the ends are spaced apart in the second direction. The primary worksurfaces are located at a first height adapted to accommodate a seated user positioned adjacent to and facing the front edge of each of the primary worksurfaces. At least one support extends upwardly from at least one of the primary worksurfaces. An auxiliary worksurface is coupled to the support and is vertically spaced from the at least one primary worksurface. The auxiliary worksurface includes a first edge spaced apart from a second edge and a length. The auxiliary worksurface is pivotable relative to the at least one primary worksurface between a use position, wherein the first edge extends in the second direction, and a stored position, wherein the first edge extends in the first direction, wherein the auxiliary worksurface is located at a second height adapted to accommodate a standing user positioned adjacent to and facing the first edge when the auxiliary worksurface is in the use position.

In another aspect, methods of assembling and using the workstations are provided.

The various embodiments of the workstations and methods provide significant advantages over other workstations. For example, and without limitation, the workstation provides a simple and robust system for accommodating both seated and standing users, but without the need for expensive and difficult to operate height adjustment systems. The auxiliary worksurface may be quickly and easily moved to a location accommodating the standing user, and then moved out of the way to accommodate a seated user situated at the primary worksurface.

In addition, the workstations may be quickly and easily assembled from a limited number of components, thereby decreasing the need for maintaining an inventory of a large number of different components while also simplifying the overall assembly process. The workstation is easily and quickly reconfigurable to accommodate different users and work environments, and can be easily modified with a variety of different accessories.

The foregoing paragraphs have been provided by way of general introduction, and are not intended to limit the scope of the claims presented below. The various preferred embodiments, together with further advantages, will be best understood by reference to the following detailed description taken in conjunction with the accompanying drawings.

BRIEF DESCRIPTION OF THE DRAWINGS

FIGS. 23B-C are partial or sectional views of the workstation of FIG. 23A.

DETAILED DESCRIPTION OF THE PRESENTLY PREFERRED EMBODIMENTS

Figure 1:
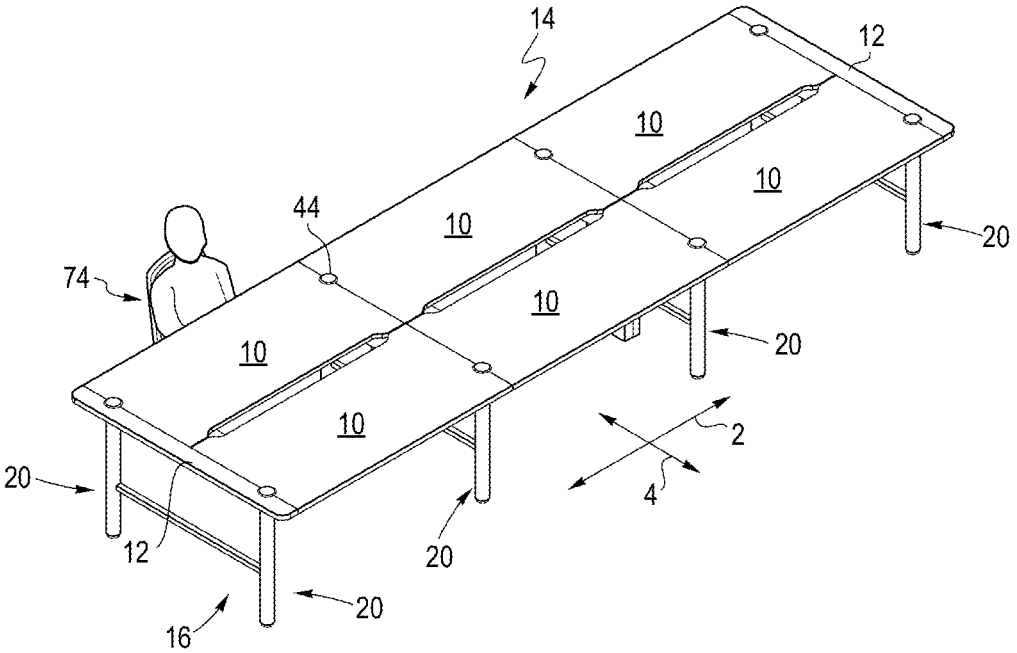
FIG. 1 is a perspective view of one embodiment of a workstation.

It should be understood that the term "plurality," as used herein, means two or more. The term "longitudinal," as used herein means of or relating to a length or lengthwise direction 2, for example a direction running from one end 12 of a primary worksurface 10 to an opposite end, or a direction defined along an axis of a post or support. The term "lateral," as used herein, means situated on, directed toward or running in a side-to-side direction 4, for example between a front edge 6 and rear edge 8 of a primary worksurface, or between posts of a leg assembly 20. The term "coupled" means connected to or engaged with whether directly or indirectly, for example with an intervening member, and does not require the engagement to be fixed or permanent, although it may be fixed or permanent. The terms "first," "second," and so on, as used herein are not meant to be assigned to a particular component so designated, but rather are simply referring to such components in the numerical order as addressed, meaning that a component designated as "first" may later be a "second" such component, depending on the order in which it is referred. It should also be understood that designation of "first" and "second" does not necessarily mean that the two components or values so designated are different, meaning for example a first direction may be the same as a second direction, with each simply being applicable to different components. The terms "upper," "lower," "rear," "front," "fore," "aft," "vertical," "horizontal," "right," "left," and variations or derivatives thereof, refer to the orientations of the exemplary workstation 14 as shown in FIG. 1, with a user seated or standing adjacent thereto. The term "transverse" means non-parallel.

Figure 2A:
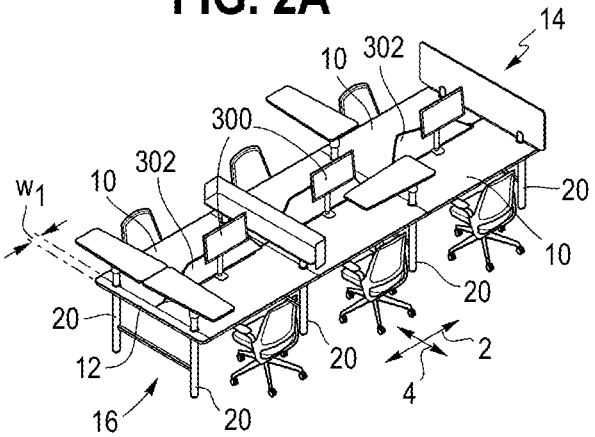
FIGS. 2A-F are perspective views of different workstation embodiments.
Figure 2B:
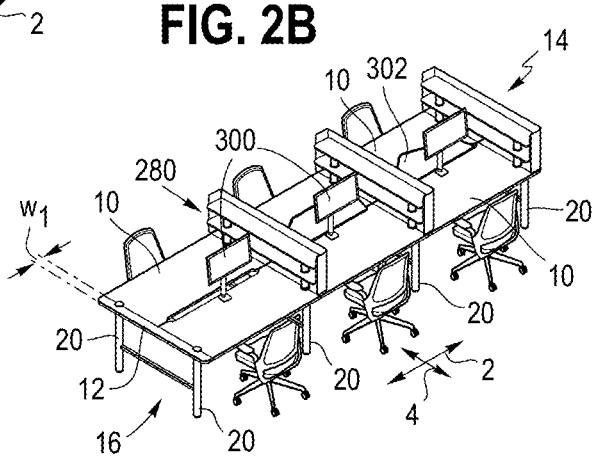
Figure 2C:
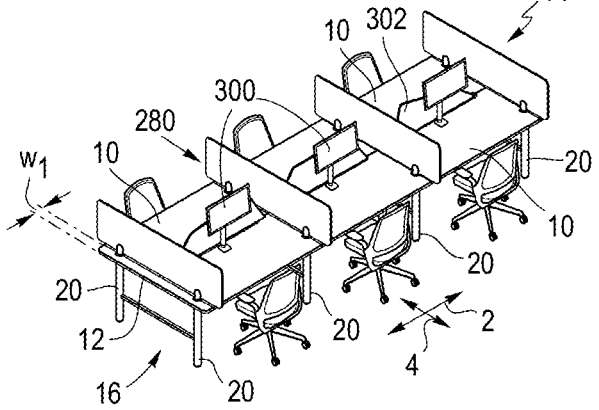
Figure 2D:
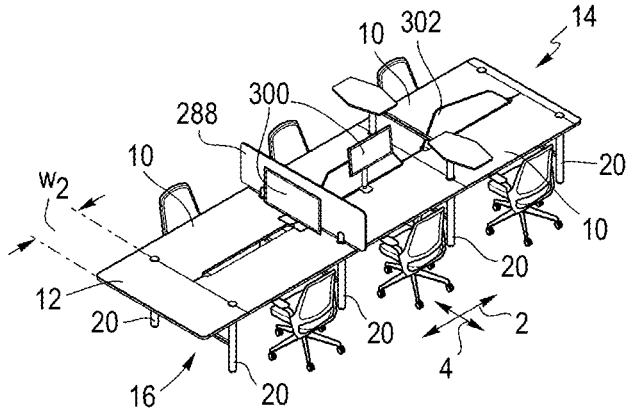
Figure 2E:
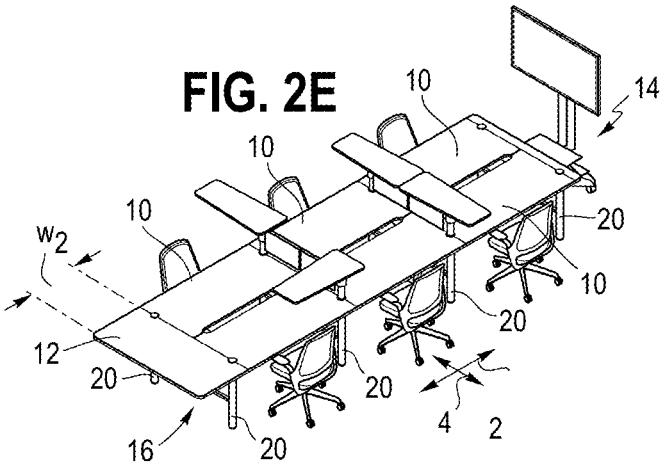
Figure 2F:
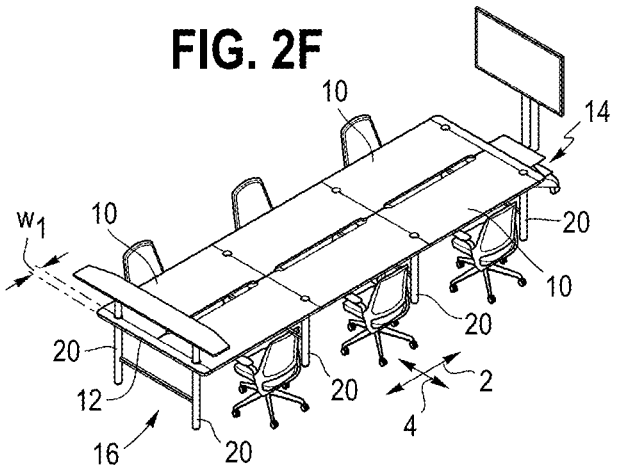
Figure 3:
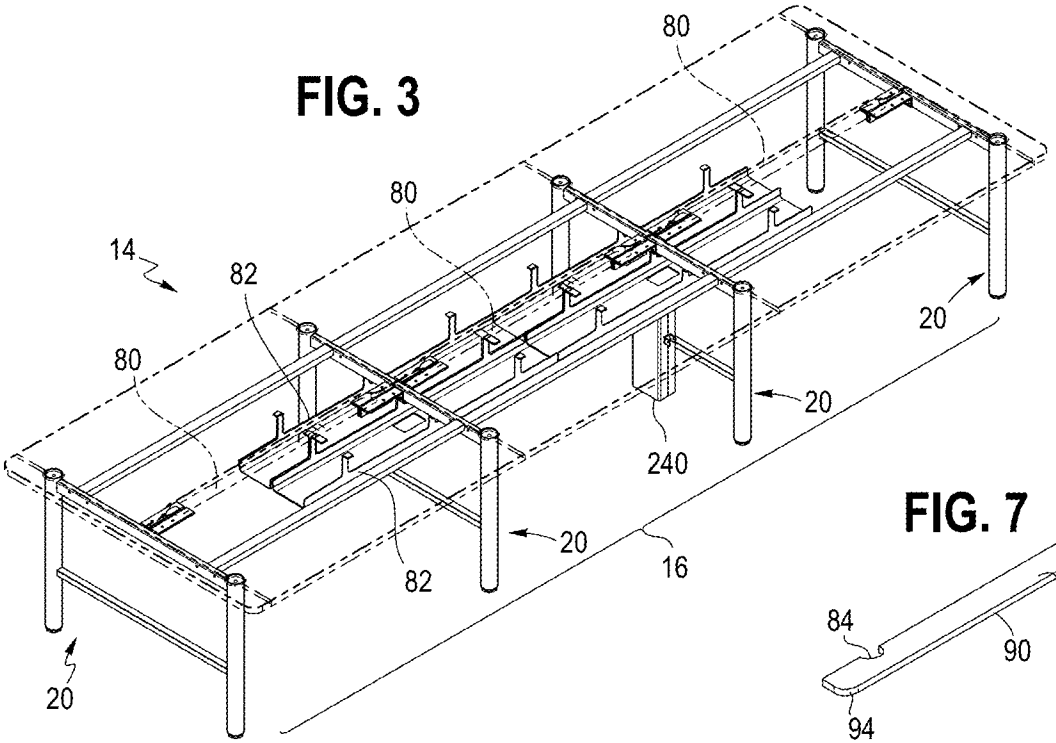
FIG. 3 is a perspective view of one embodiment of a workstation understructure.
Figure 4:
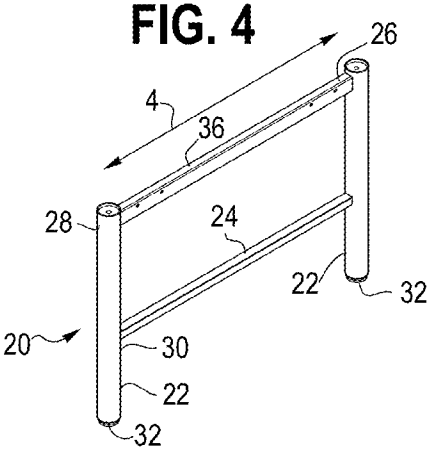
FIG. 4 is a perspective view of one embodiment of a leg assembly.

Understructure:

Referring to FIGS. 1-8, various workstation embodiments are shown with an understructure 16. The understructure may support a single primary worksurface 10, or a plurality of primary worksurfaces 10. In one embodiment, the understructure includes a leg assembly 20 and one or more beams 18. As shown in FIG. 4, one embodiment of a leg assembly 20 includes a pair of posts 22 spaced apart laterally in a first, e.g., lateral direction 4. The posts 22 are connected with at least one cross member 24, 26. In one embodiment, upper and lower cross members 26, 24 extend laterally and are connected to the posts, for example at an upper end 28 and at an intermediate location 30. The cross members 24, 26 may be connected to the posts with fasteners, such as tabs, hooks and/or screws, or may be welded thereto. The bottom 32 of the posts are engaged with the ground, for example a floor, and may include a floor interface component such as a caster or glide.

Figure 15A:
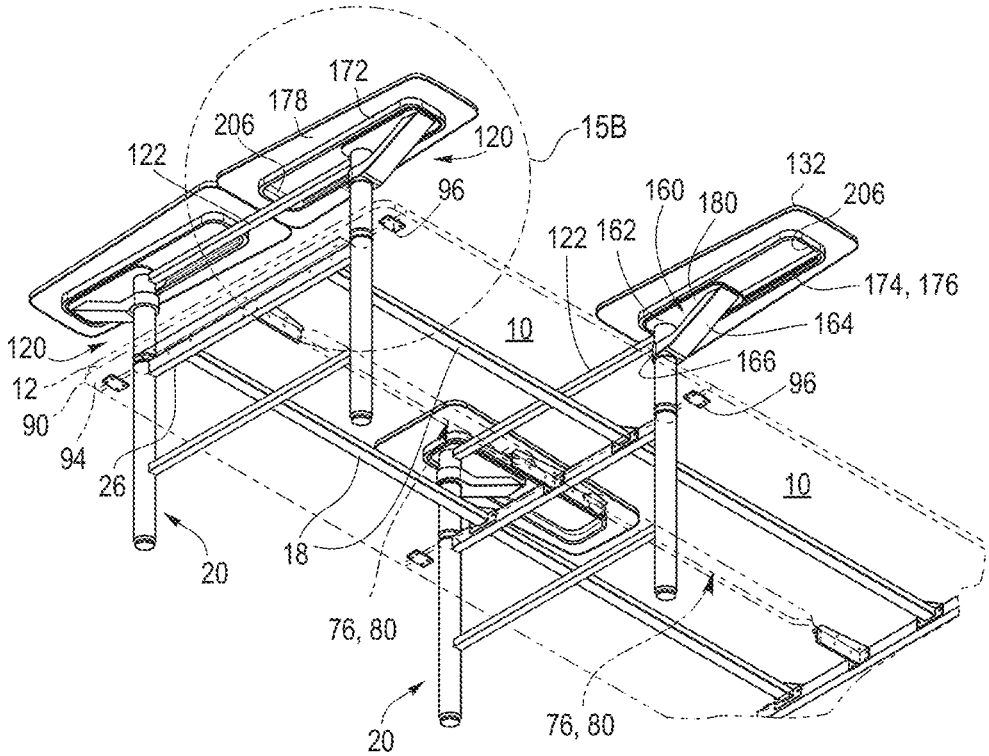
FIG. 15A-C are a partial, bottom perspective view of one embodiment of a workstation and support for an auxiliary worksurface.
Figure 15B:
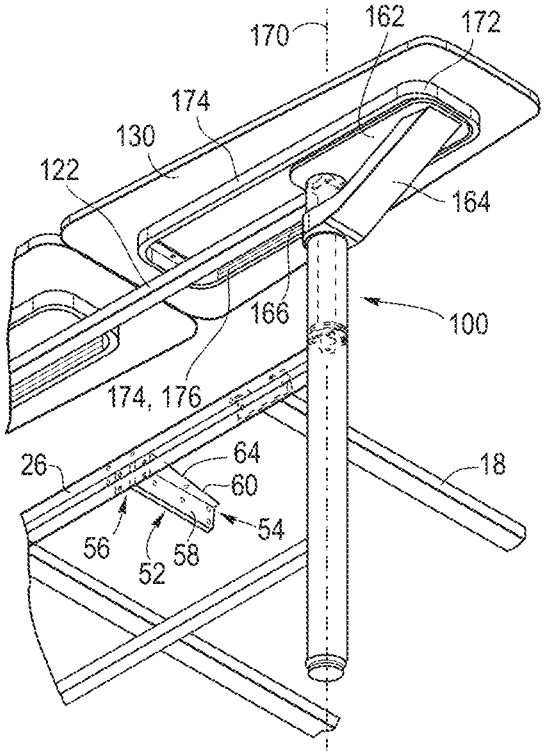
Figure 15C:
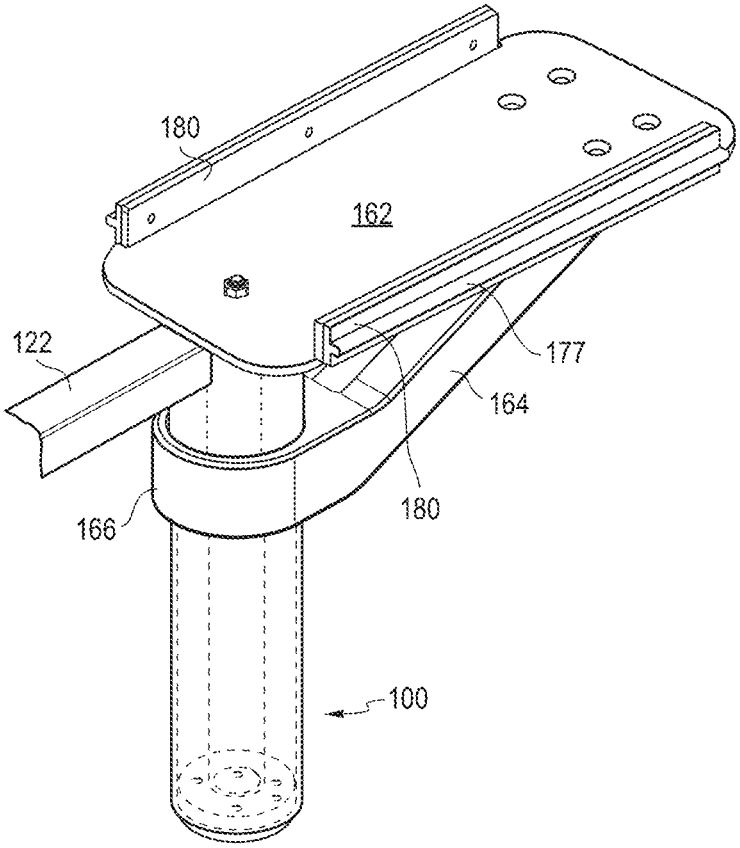
Figure 21:
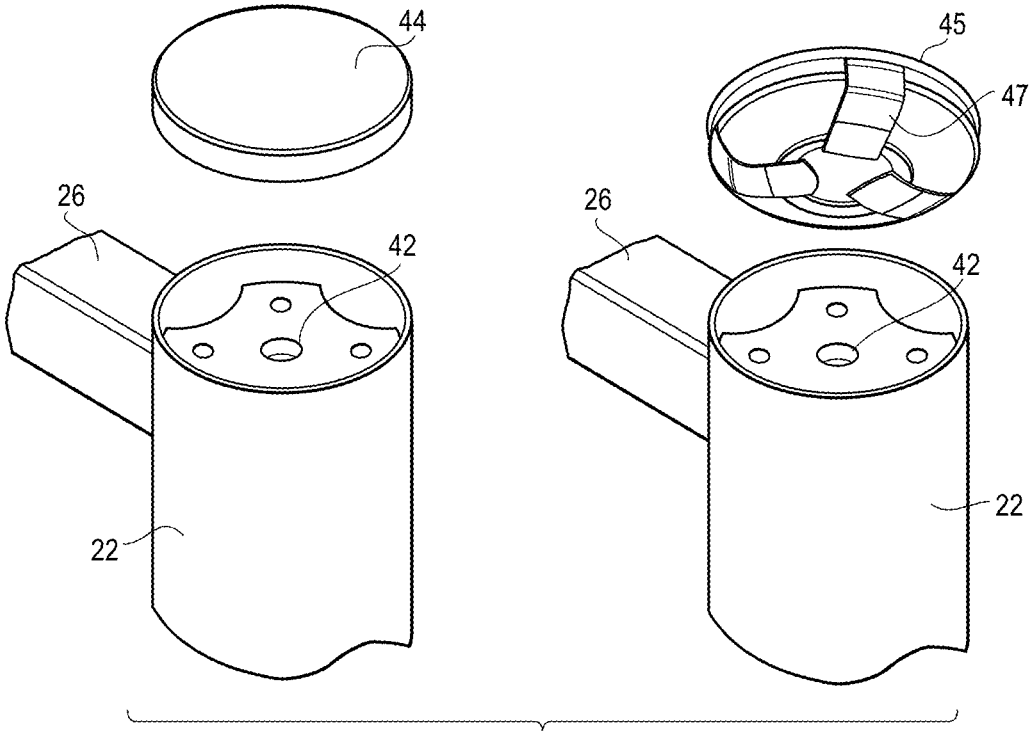
FIG. 21 is a partial exploded view of a cap and post.

A pair of beams 18 extend longitudinally in a second (e.g., longitudinal) direction 2 and are connected to a pair of longitudinally spaced apart leg assemblies 20. In one embodiment, the beams 18 are laterally spaced in the lateral direction 4 and are connected to the upper cross member 26 of the spaced apart leg assemblies. The upper surfaces 34, 36 of the beams and upper cross member preferably lie flush, and provide a mounting surface for the primary worksurface 10. The upper end 28 of the posts extends upwardly from the mounting surfaces, for example a distance proximate, or equal to, the thickness of the primary worksurface 10, such that the uppermost end surface of the posts lies flush with an upper surface 38 of the primary worksurface. The posts 22 are configured as tubes in one embodiment, with the post being open at a top thereof adjacent the upper surface 38 of the primary worksurface. As shown in FIG. 15A, a plate 42 may be welded near the top of the tube. If not used as an accessory or support, as described herein below, a cover or cap 44 may be positioned in and over the open top and secured to the post as shown in FIGS. 1 and 21, for example by threaded or interference fit. In one embodiment, shown in FIG. 21, the cap 44 includes a support structure 45 with resilient supports 47, with the cap 44 snapping onto the post 22 by way of interference fit. The beams 18 may be connected to the leg assemblies 20 with fasteners, such as tabs, hooks, and/or screws, and/or may be welded thereto. The beams may include end brackets 46, shown for example in FIG. 19, coupled to the cross members 26 and to the beam 18. The end brackets 46 may include locator tabs 48 that rest on top of the cross member to support and locate the beams during installation. The brackets also have horizontal gussets 50 that may be coupled to a bottom surface 40 of the primary worksurface 10. The beams 18 may be made of metal, for example as a rectangular tubular structure, I-beam, C-channel, or other structural shape that has moment of inertia providing adequate bending strength.

Figure 5:
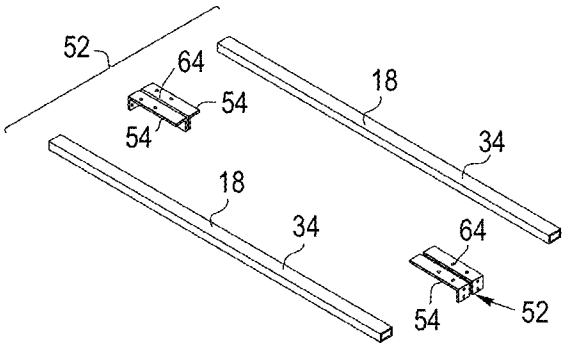
FIG. 5 is a perspective view of beam and bracket portion of one embodiment of an understructure.
Figure 7:
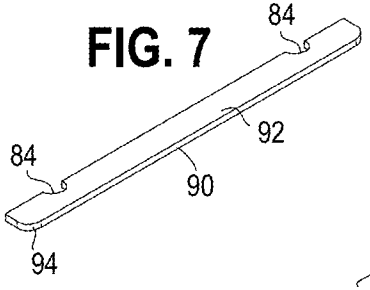
FIG. 7 is a perspective view of one embodiment of an end surface.
Figure 16:
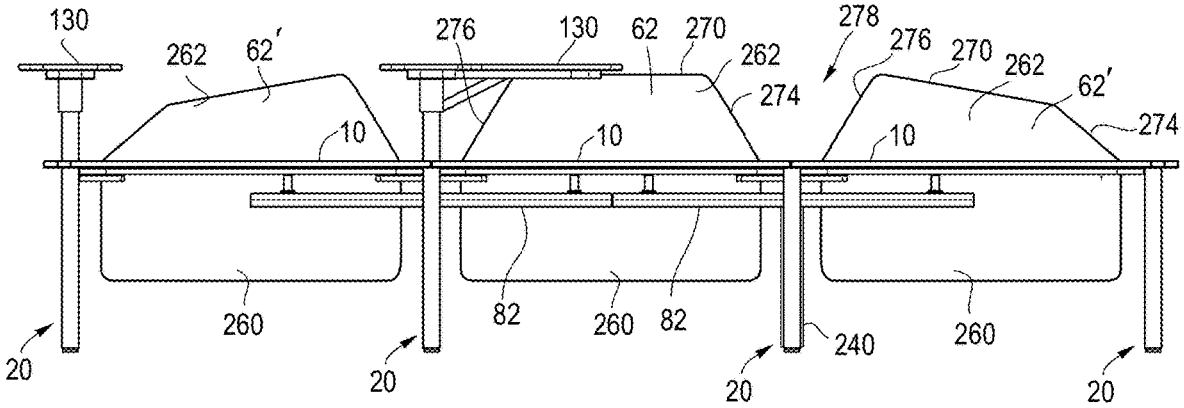
FIG. 16 is a side view of one embodiment of a workstation.
Figure 17:
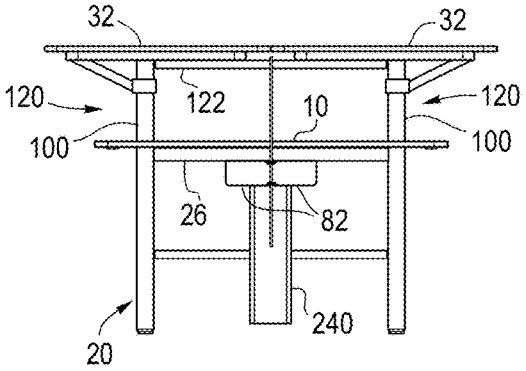
FIG. 17 is an end view of the workstation shown in FIG. 16.

A support 52 includes pairs of brackets that 54 are coupled to opposite facing sides of the cross beams, as shown for example in FIGS. 5, 15A and B. The brackets may include a first vertical flange 56 that may be connected to the side of the cross member, for example with fasteners or by welding, and a second vertical flange 58 and a horizontal flange 60 extending in the longitudinal direction. The second vertical flanges 58 may be connected to each other, or to a screen 62 disposed between the vertical flanges, as shown in FIG. 16 and described in more detail further below. The support 52, and the horizontal flanges 60 in particular, have an upper surface 64 lying flush with the upper surfaces 34, 36 of the beams and cross member. The support, including the pair of brackets, may be coupled to a pair of abutting, or adjacent primary worksurfaces with fasteners, such as screws, staples, tabs, etc.

In one embodiment, the workstation 14 includes a plurality of leg assemblies 20 spaced apart in the second (longitudinal) direction 2. In one embodiment, the understructure 16 includes "n1" leg assemblies 20 spaced apart in the second direction 2 and "n2" pairs of beams 18 spaced apart in the lateral, first direction 4, and extending in the second direction 2 and connecting the leg assemblies 20, wherein n2=n1−1. For example, as shown in FIGS. 1, n1=4 and n2=4−1=3.

Figure 9B:
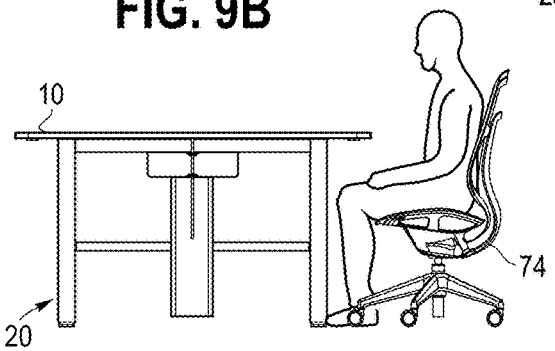
FIG. 9B is an end view of the workstation shown in FIG. 9A.
Figure 10B:
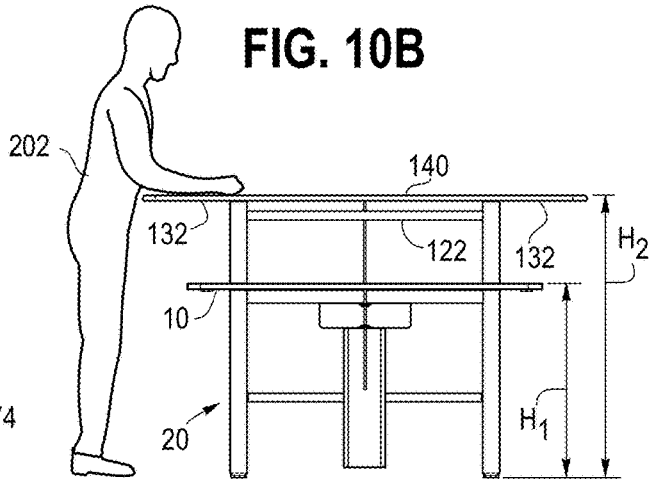
FIG. 10B is an end view of the workstation shown in FIG. 9A.
Figure 11B:
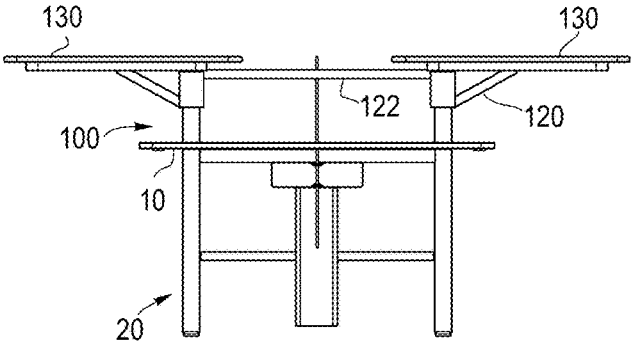
FIG. 11B is an end view of the workstation shown in FIG. 9A.

Primary Worksurfaces:

Referring to FIGS. 1-2F, 6, 9A-19, the workstation 14 is configured with at least one primary worksurface 10, and in one embodiment, includes "n3" primary worksurfaces 10 supported by the understructure 16, wherein n3=2×n2. For example, if n2=3, n3=6, or three pairs of two primary worksurfaces. In an alternative embodiment, two of the primary worksurfaces 10 positioned back-to-back may be configured as a single worksurface, with n3=n2. In the embodiment shown in FIG. 1, each primary worksurface 10 has a front edge 6, a rear edge 8 and opposite ends 12, otherwise referred to as side edges. The primary worksurfaces may be made of any suitable material, including without limitation wood, metal, plastic, particle board or other composite materials, and/or may be finished with a coating or laminate. The front and rear edges 6, 8 are spaced apart in a first direction 4 orthogonal to the second direction 2, and the ends 12 are spaced apart in the second direction 2. Each primary worksurface 10 has an upper surface 38 and a bottom surface 40, with the bottom surface 40 connected to the beam 18, cross member 26 and one of the support brackets 54. The primary worksurfaces 10, and in particular the upper surface thereof 38, are located at a first height (H1) adapted to accommodate a seated user 74 positioned adjacent to and facing the front edge of each of the primary worksurfaces, as shown for example in FIGS. 1 and 9B. The rear edges 8 of the primary worksurfaces are non-linear, or define a cutout 76, for example an elongated concave cutout with curved end edges and a straight edge extending therebetween. The rear edge further defines a pair of shoulder portions 78 positioned on each side of the cutout. A pair of cutouts 76 face each other when two primary worksurfaces 10 are arranged with the rear edges 8 being adjacent, with the shoulder portions 78 abutting. The pair of cutouts 76 define a central, elongated opening 80 extending in the second, longitudinal direction 2. Power cords, data cables and other utilities may be passed from the upper surface 38 of the worksurface through the opening 80 and into cable tray(s) 82 underlying the openings.

In addition, each end of the primary worksurfaces 10 includes a cutout 84 shaped to mate with an outer profile of one of the posts 22. For example, the cutout 84 may be a concave shape, for example with a semi-circular edge. The phrase "shaped to mate" refers to the edge of the cutout generally following the shape the outer profile of the post. The edge of the cutout may abut the surface of the post, or may be slightly spaced therefrom, or may overlap, for example when the cutout is positioned above a top surface of the post. In one embodiment, a grommet 86 is disposed between the edge of the cutout and the outer surface of the post, as shown for example in FIG. 18.

Referring for example to FIGS. 1-2F, 7, 9A, 10A, 11A, 15A, 16 and 18, an end surface 90 may also be connected to one of the four leg assemblies 20 adjacent an exposed one of the ends 12 of one of the primary worksurfaces. The end surface 90 has an upper surface 92 lying flush with the upper surfaces 38 of the primary worksurfaces 10. The end surface 90 has a bottom surface 94 that is supported by and coupled to the upper surface 36 of the cross member of the leg assembly. A single end surface extends along the width of two abutted primary worksurfaces positioned rear edge to rear edge. The end surface 90 includes a pair of cutouts 84 shaped to mate with the outer profiles of the pair of posts 22 of the leg assembly 20 connected thereto. As shown in FIGS. 2A, the end surface has a first width (W1) with the end surface providing a finished look to the workstation, while in FIG. 2D, the end surface has a width (W2) greater than the first width (W1) that defines an individual workspace accommodating a user situated in front of the end surface 90. A pair of end surfaces 90 may be connected to endmost leg assemblies 20 adjacent an exposed one of the ends 12 of one of the primary worksurfaces 10, wherein the end surface 90 includes a pair of cutouts 84 shaped to mate with outer profiles of the pair of posts 22 of the leg assembly 20 connected thereto.

As show in FIG. 15A, connectors 96, configured for example as a plate, may bridge between and be connected to adjacent ends 12 of the primary worksurfaces 10, or between the end surface 90 and one of the primary worksurfaces 10. The connectors 96 may be secured to the bottom surfaces 40, 94 of the primary worksurface(s) 10 and end surface 90 with fasteners, such as screws. The connectors 96 help secure, stabilize and maintain the flushness of the adjacent primary worksurface(s) 10 and/or end surface(s) 90.

Auxiliary Work Surfaces:

Referring to FIGS. 2A-F, 10A-11B, 14, 16, and 17, a support 100, 102, for example a support column, extends upwardly from one of the primary worksurfaces 10, meaning it has a length that extends vertically above the upper surface 38 of the worksurface. The support 102 may be coupled directly to the worksurface, as shown in FIG. 14, or the support 100 may be coupled to the leg assembly 20, for example to the upper end 28 of the post exposed between two adjacent primary worksurfaces 10, or between a primary worksurface 10 and an end surface 90.

Figure 22A:
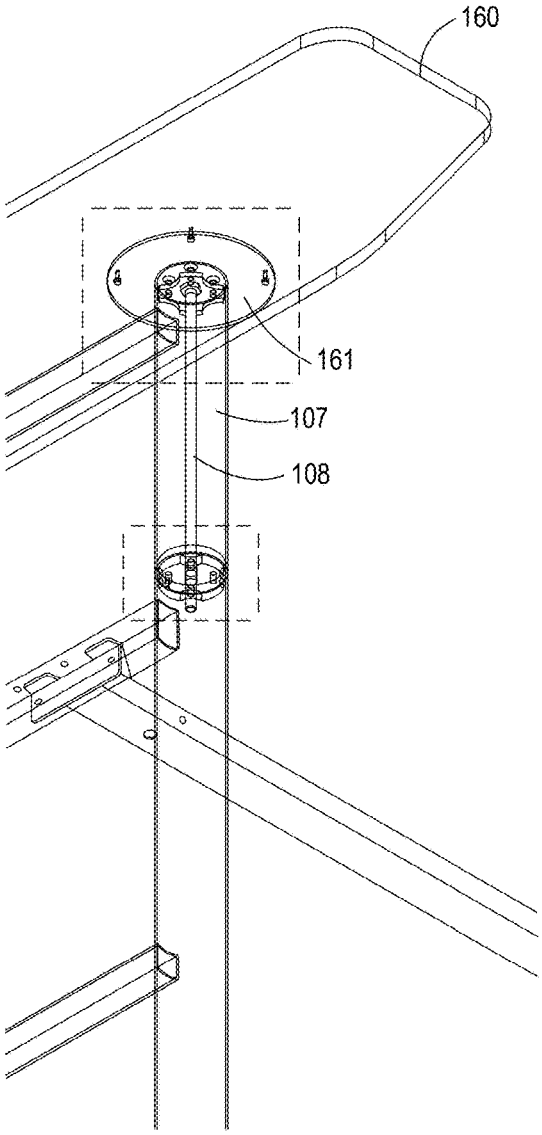
FIG. 22A are perspective view of another embodiment of a workstation and support for an auxiliary worksurface.
Figure 22B:
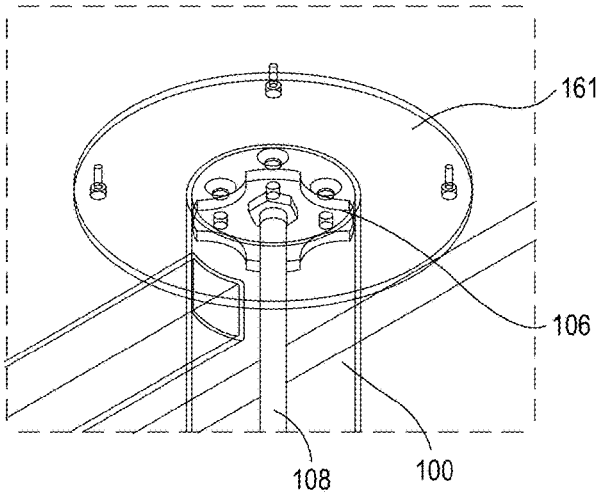
FIGS. 22B-C are partial views of the support for an auxiliary worksurface of FIG. 22A.
Figure 22C:
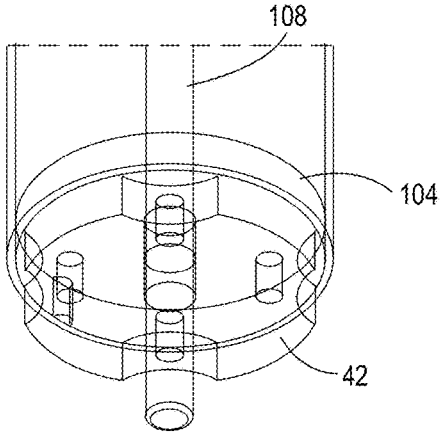

As shown in FIGS. 2A, D and E, 10A, B and 11A, B, the support 100 may be coupled to the post 22. The support 100 may be non-rotationally fixed relative to the post 22, or may be rotationally supported by the post. In one embodiment, the support 100 has a bottom plate 104 that is coupled to the plate 42 secured (e.g., welded) in an upper end of the post 22, as shown in FIGS. 22A-C. The bottom plate 104 is for example pre-welded to the bottom of the support 100. The two plates 42, 104 may be connected with a plurality of fasteners. The support 100 includes a tube 107, having a diameter or outer profile matching the diameter or outer profile of the post 22, disposed over the plate 104 and extending upwardly in a vertical direction therefrom. An upper plate 106 is secure in the upper end of the tube. The upper plate 106 is for example pre-welded to the upper end of the support 100. A clamping member, for example an elongated bolt 108, engages the upper plate and may extend vertically between the plates 106, 104 and is threadably engage with the plate 104, such that the support 100 is secured to the post 22. The elongated bolt may also extend through the bottom of the bottom plate 104 from the top of the upper plate 106. A support structure 160 may include a base structure 161, which may be circular, oval, or any other suitable shapes. The base structure 161 of the support structure 160 is connected to the upper plate 106 of the support 100, such as by means of additional fasteners, so that the support structure 160 is connected to the support 100. Accordingly, the support structure 160 is connected in a fixed manner to the support 100 and thus to the post 22 in a fixed manner. Thus, in this embodiment, the support structure 160 may act as a fixed surface for connection to the post 22.

Figure 14A:
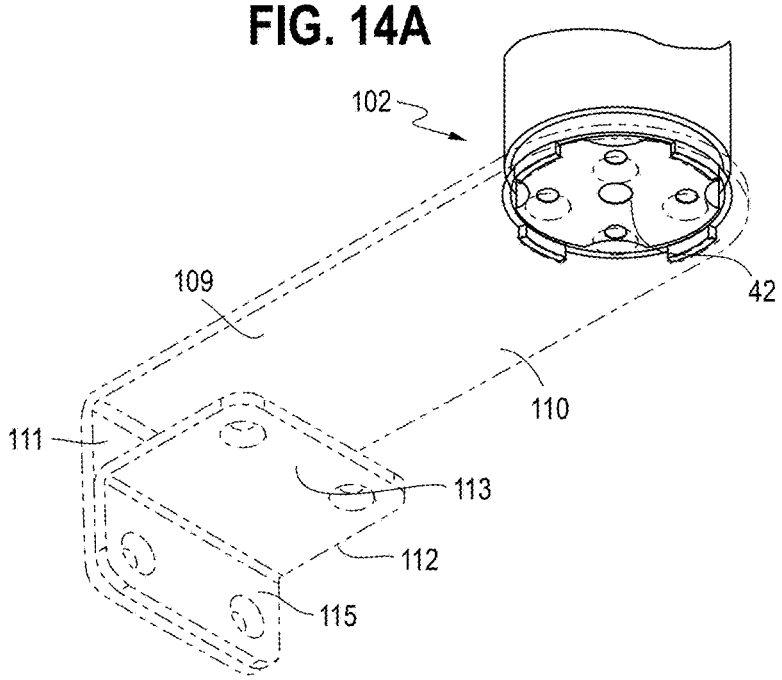
FIGS. 14A and B are perspective view of alternative support systems for accessories and auxiliary worksurfaces.
Figure 14B:
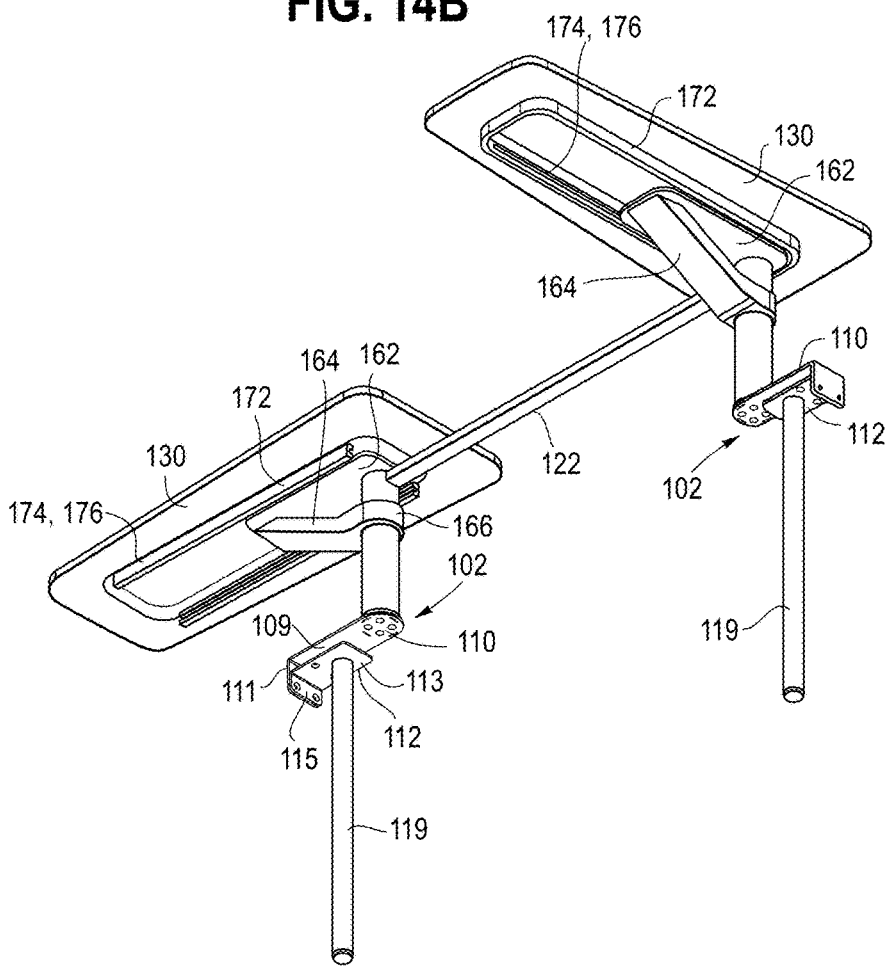
Figure 20:
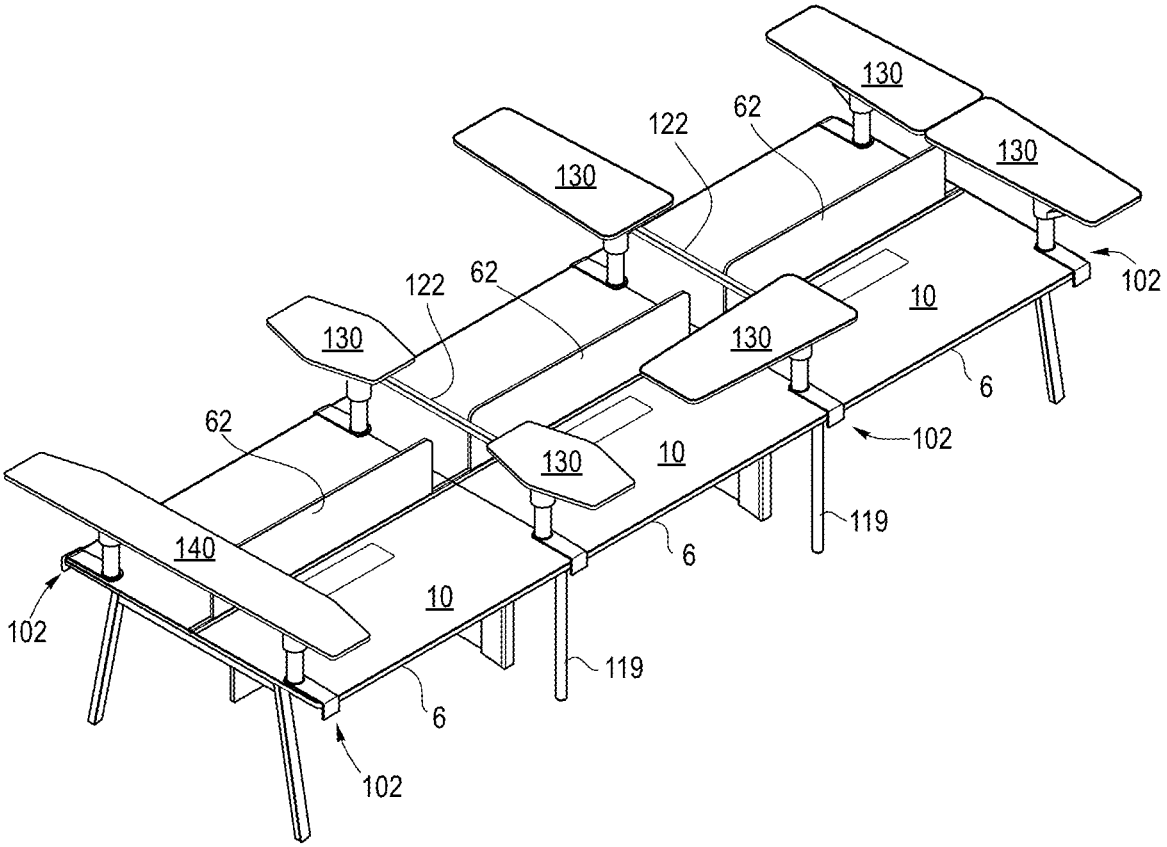
FIG. 20 is a perspective view of an alternative workstation embodiments.

Alternatively, as shown in FIGS. 14A and B and FIG. 20, the support 102 has a bottom connector, shown as including a horizontal flange 110 that rests on the upper surface 38 of one (or a pair) of primary surfaces, and a vertical flange 111 positioned adjacent the front edge(s) 6 of the primary worksurfaces 20. An L-shaped bracket 112 includes a vertical flange 115 that may be secured to the vertical flange 111 and a horizontal flange 113 that may be secured to the bottom of the primary worksurface. The primary worksurface(s) 10 is disposed between the horizontal flange 113 of the bracket 112 and the horizontal flange 110 of the bottom connector, with the worksurface clamped therebetween. If additional support is required, for example where an auxiliary worksurface is being supported as shown in FIGS. 14B and 20, an auxiliary leg 119 may be secured to the bracket 112, and the horizontal flange 113 in particular. The leg 119 engages the floor and provides additional support to the bottom connector and support 102.

Regardless, in both embodiments, the support 100, 102 extends upwardly from the primary worksurface 10 at a location closer to the front edge 6 than the rear edge 8. In one embodiment, a support assembly 120 includes a pair of laterally spaced supports 100, 102, connected for example with a cross member 122 that extends therebetween in the lateral direction 4. In one embodiment, the cross member 122 is welded to the supports 100, 102.

Figure 10A:
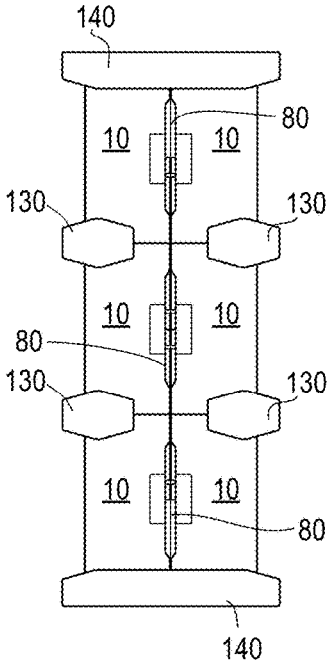
FIG. 10A is a top view of one embodiment of a workstation.

Referring to FIGS. 10A and B, one or more auxiliary worksurface(s) 130 are coupled to the one or more supports 100, 102. For example, individual auxiliary worksurfaces 130 may be coupled to a corresponding one of the supports 100, 102. The auxiliary worksurfaces 130 may have any plan view shape, for example a polygonal shape, including a rectangle, hexagonal, etc., or may have an elliptical shape, such as a circle. In one embodiment, shown in FIGS. 10A and B, the auxiliary worksurfaces 130 are non-rotationally fixed to the support 100, 102, for example with a support collar 132. In on embodiment, an elongated auxiliary worksurface 140 extends between a pair of supports.

In another embodiment, and referring to FIGS. 2A-F, 11A, B, 12, 15A-18, a support structure 160 includes a base member 162 rotatably coupled to the top of the support 100, wherein the base member extends horizontally from a vertical axis 170 of the support 100. A brace 164 extends downwardly and inwardly from an end of the base member 162 towards the support 100. The brace 164 is rotatably coupled to the support, for example with a collar 166. In this way, the support structure 160 is rotatable about the axis 170 of the support 100. The collar 166 may be provided with set screws to allow control of the tightness of the rotation as the support structure 160 rotates about the axis of the support 100. This same type of support structure 160 may be coupled to the support 102, which is clamped to the primary worksurface 10.

Figure 11A:
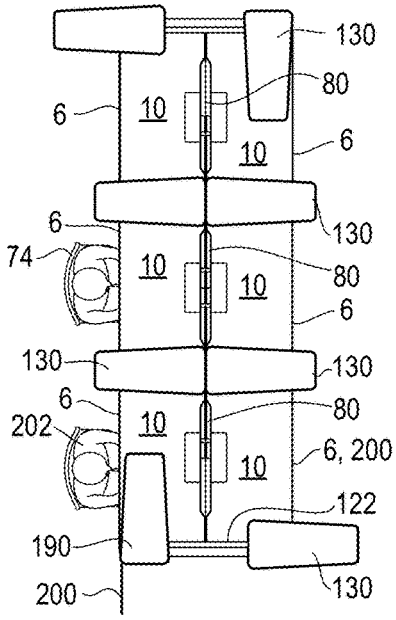
FIG. 11A is a top view of one embodiment of a workstation.
Figure 12:
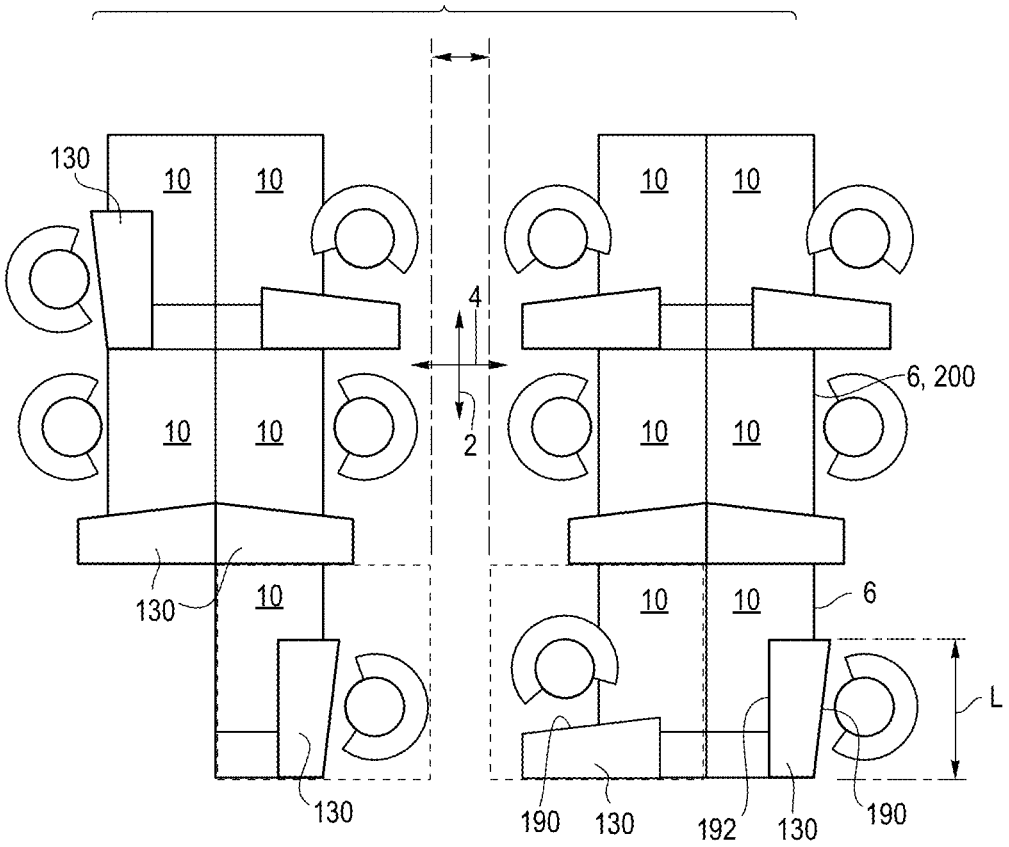
FIG. 12 is a top view of a pair of workstations.

The auxiliary worksurface 130 incudes a ring like support 172 secured to a bottom surface 178 thereof, with the ring like support surrounding and slidably engaging sides 180 of the base member. The side walls 174 of the support include tracks 176 that slidable engage corresponding guides 177 arranged along the sides 180 of the base member, shown as side wall in FIG. 15C. The tracks/guides 176, 177 interface to prevent the auxiliary worksurface 130 from being disengaged from the base member 162 while simultaneously allowing translation, e.g., sliding movement, between the auxiliary worksurface 130 and the base member 162. It should be understood that the profiles of the tracks/guides may be reversed, with the guides arranged on the support 172 and the tracks arranged on the base member 162. The auxiliary worksurface 130 includes a first edge 190 spaced apart from a second edge 192 and a length (L). The auxiliary worksurface 130 is pivotable relative the primary worksurface 10, for example about the vertical axis 170 defined by the post 22 and the support 100, between a use position, wherein the first edge 190 extends in the second longitudinal direction 2 and wherein at least a portion of the first edge 190 overlies the front edge 6 of the primary worksurface, and a stored position, wherein the first edge 190 is extends in the first direction. It should be understood that first edge 190 may extend in the first and second directions, even if the first edge is not parallel to the front edge, or those directions. Rather, the first edge has a primary vector parallel thereto. In some embodiments, the first edge may be parallel to the front edge in the use position. The term "overlies" refers to a portion the first edge 190 lying proximate, abutting and/or intersecting a vertical plane 200 defined by the front edge 6 of the primary worksurface 10. It should be understood that the front edge may not be linear, such that the "plane" also is not linear, but rather is a vertical projection of the front edge. As shown in FIGS. 11A and 12, while the first edge 190 of one of the auxiliary worksurfaces in a use position angles inwardly (FIG. 11A) or outwardly (FIG. 12), a portion of the first edge 190, e.g, a portion adjacent the vertical pivot axis 170, is proximate or flush with the plane 200 defined by the front edge 6. Moreover, it should be understood that the first edge 190 "overlies" the front edge if at least a portion of the first edge is within a certain distance of the plane 200 defined by the front edge, for example within ±6 inches, or more preferably within ±3 inches.

In operation, the ring like support 172 and base member 162 pivot with the auxiliary worksurface between the use and stored positions. The auxiliary worksurface(s) 130 are located at a second height (H2) adapted to accommodate a standing user 202 positioned adjacent to and facing the first edge 190 when the auxiliary worksurface 130 is in the use position. The auxiliary worksurface 130 is also translatable relative to the vertical axis 170 within a horizontal plane. For example, the auxiliary worksurface 130 may slide relative to the support as the track slides relative to the base member 162. The base member 162 engages or abuts the opposite ends 206 of the track to define stops, which limit the amount travel. The auxiliary worksurface 130 is independently translatable and rotatable, meaning the auxiliary worksurface may be rotated without being translated, translated without being rotated, or simultaneously rotated and translated. As shown in FIGS. 11A and 12, ends of the auxiliary worksurfaces coupled to spaced apart supports are abutted when in the stored position. One or both auxiliary worksurfaces may be first translated in the lateral direction 4 until sufficient spacing is achieved to allow for rotation of the auxiliary worksurfaces 130.

Accessories:

Besides the auxiliary worksurface, various other accessories may be coupled to the understructure 16.

Figure 8:
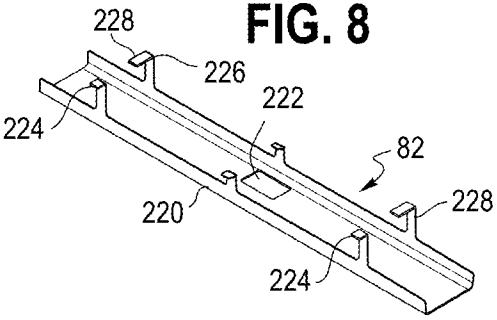
FIG. 8 is a perspective view of one embodiment of a cable tray.
Figure 6:
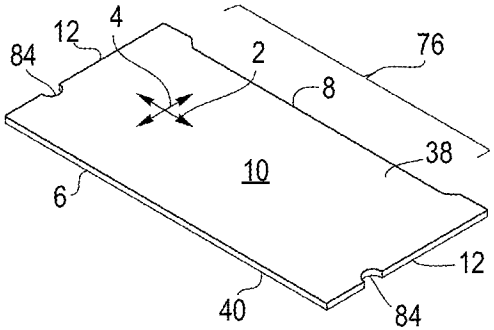
FIG. 6 is a perspective view of one embodiment of a primary worksurface.
Figure 9A:
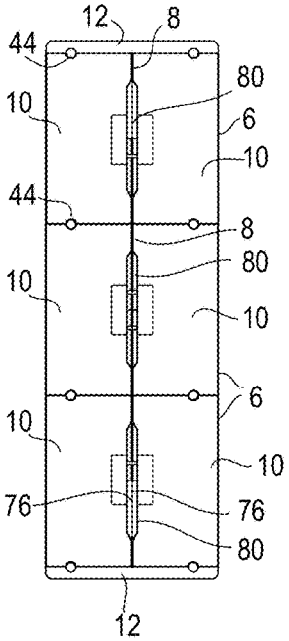
FIG. 9A is a top view of one embodiment of a workstation.
Figure 18:
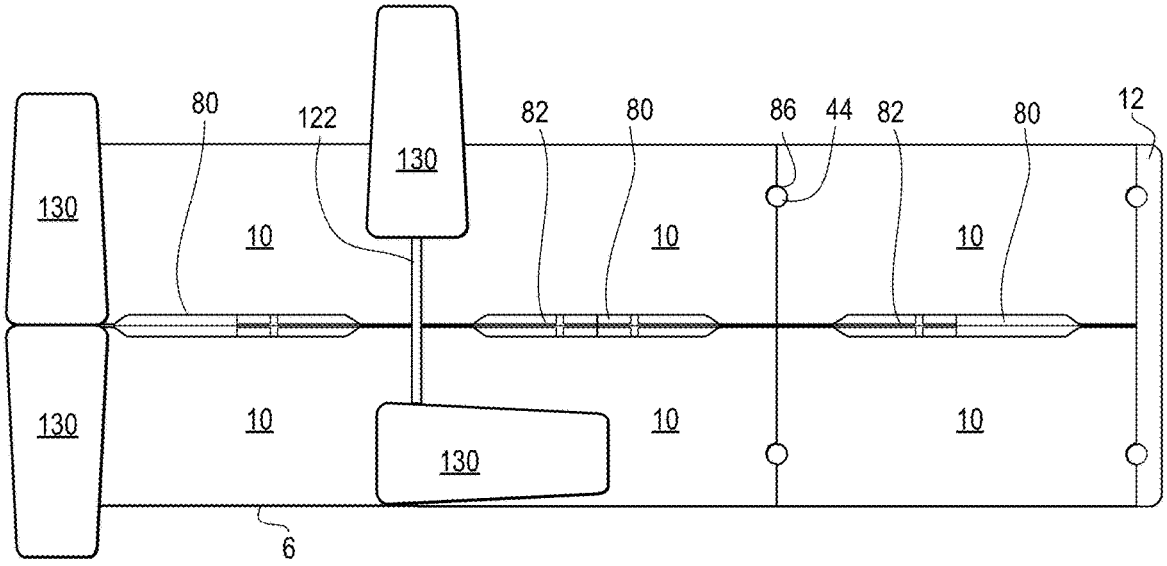
FIG. 18 is a top view of the workstation shown in FIG. 16.
Figure 19:
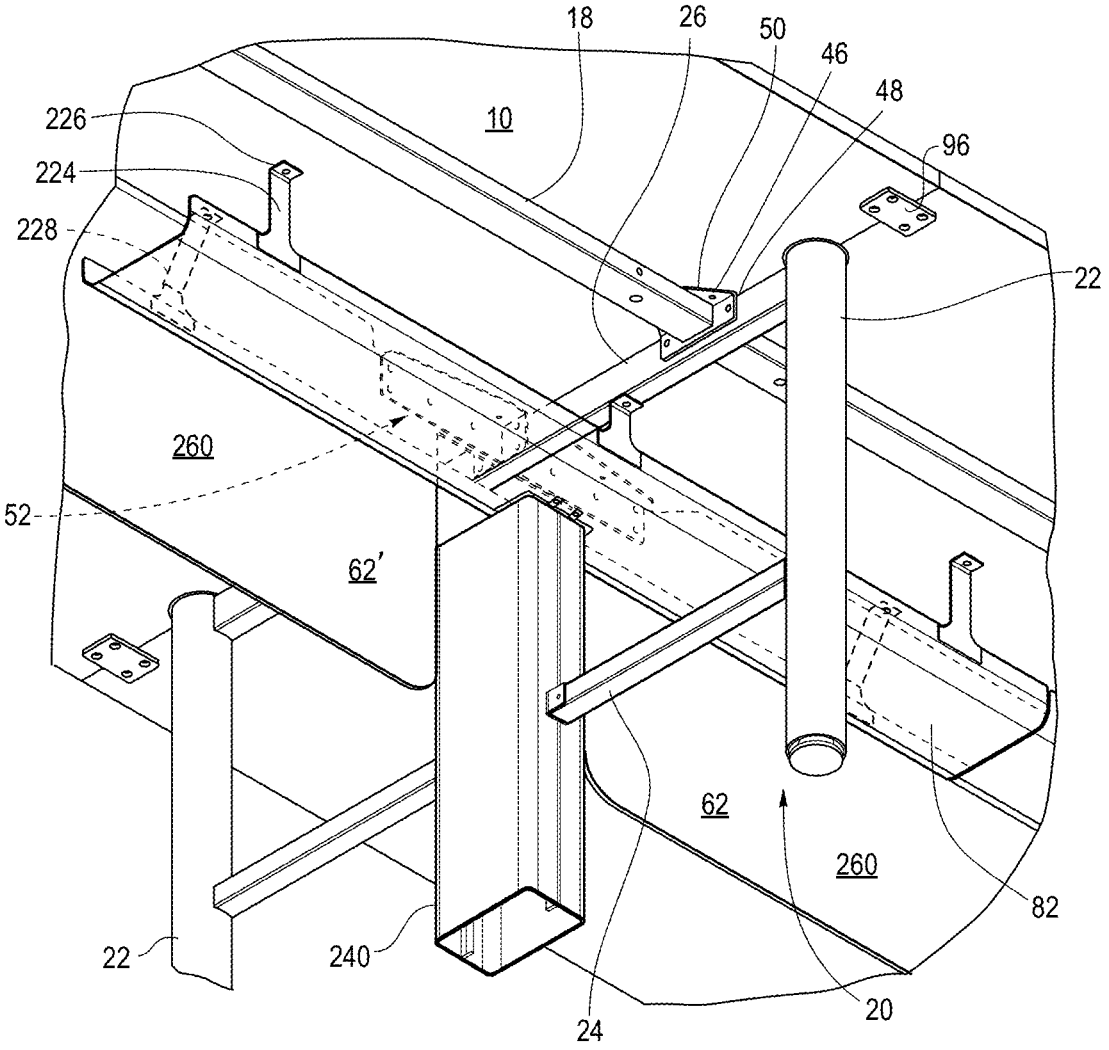
FIG. 19 is a partial, bottom perspective view of another embodiment of a workstation.

As shown in FIGS. 3 and 8, a cable tray 82 includes an elongated tray portion 220, configured for example as an upwardly opening channel with a bottom and laterally spaced side walls, extending in the second, longitudinal direction 2. The bottom thereof may include an enlarged opening 222 to permit passage of cables, wires, and other utilities. A plurality of arms 224, 228, each including an upper horizontal flange 226 extend upwardly from the tray portion 220. In one embodiment, as shown in FIG. 19, arms 228 positioned along the rear wall of the tray are angled inwardly over the tray such that the horizontal flanges 226 will be positioned beneath the associated primary worksurface and to accommodate the cutout 76. A pair of trays 82 secured to abutting primary worksurfaces have rear walls positioned adjacent to each other, and may be abutting, or may be flexed away from each other to accommodate a screen 62 disposed therebetween as shown in FIGS. 16-19. The horizontal flanges 226 may be secured to the bottom surface 40 of the primary worksurface 10, for example with fasteners, such as screws, staples, tabs, etc. As shown in FIGS. 16 and 18, the tray 82 may bridge between a pair of primary worksurfaces positioned end-to-end, or a run of trays 82 (e.g., two), may be arranged end-to-end to accommodate three primary worksurfaces arranged end-to-end. As shown in FIG. 18, for example, the trays 82 in such an arrangement only partially underlie the openings 80 created by the cutouts 76 of the pairs of primary worksurfaces arranged on either end of the run of trays. A vertical riser 240 may be coupled to the bottom of the trays 82 in communication with the opening 222 and provide a utility raceway between the floor and the trays, used for example to route cables, cords and the like to outlets arranged along the floor or to other floor raceways (not shown).

As shown in FIGS. 16-19, a plurality of screens 62, 62' may be arranged between the trays 82, and between the rear edges 8 of adjacent primary worksurfaces. Each screen 62, 62' has a modesty portion 260 that extends vertically downwardly from the primary worksurfaces 10 and a privacy portion 262 that extends vertically upwardly from the primary worksurfaces 10. The screens 62 may have a profile defining any shape, including various polygonal shapes, e.g., a rectangular modesty portion that maximizes coverage. A pair of outer screens 62' may have a tapered upper surface, defined by an angled top edge 270 and a pair of side edges 274, 276, while a centrally located screen 62 has a horizontal top edge 270, with triangular shaped openings 278 between the side edges allowing and promoting communication between individual workspace defined by the workstation. The screens 62, 62' are secured between and coupled to the vertical flanges 58 of the brackets 54, for example with fasteners such as screws or bolts/nuts.

Figure 13A:
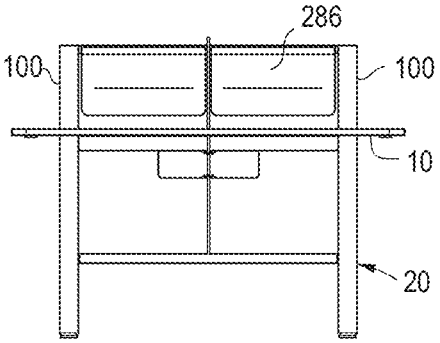
FIGS. 13A-C are end views of various workstation embodiments.
Figure 13B:
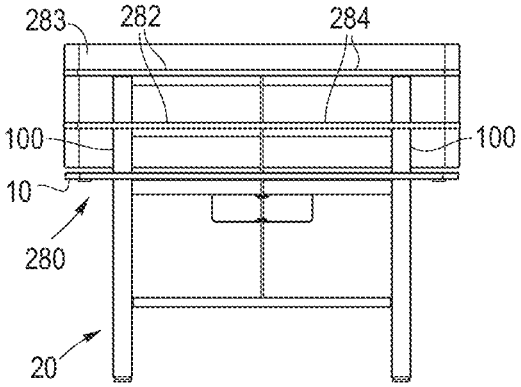
Figure 13C:
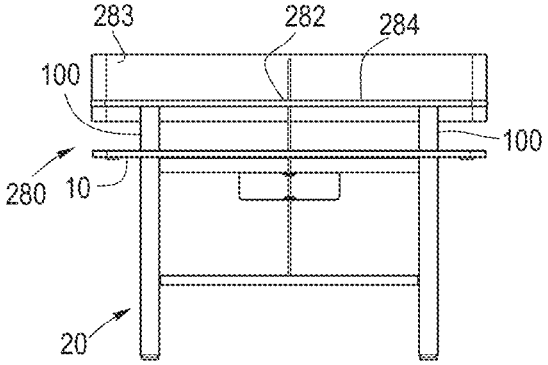
Figure 23A:
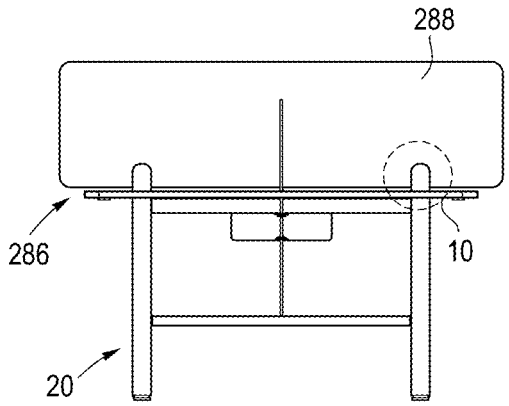
FIG. 23A-B is an end view of another workstation embodiment with screen.
Figure 23B:
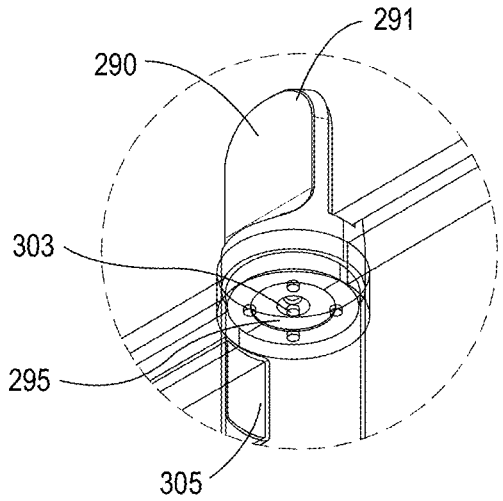
Figure 23C:
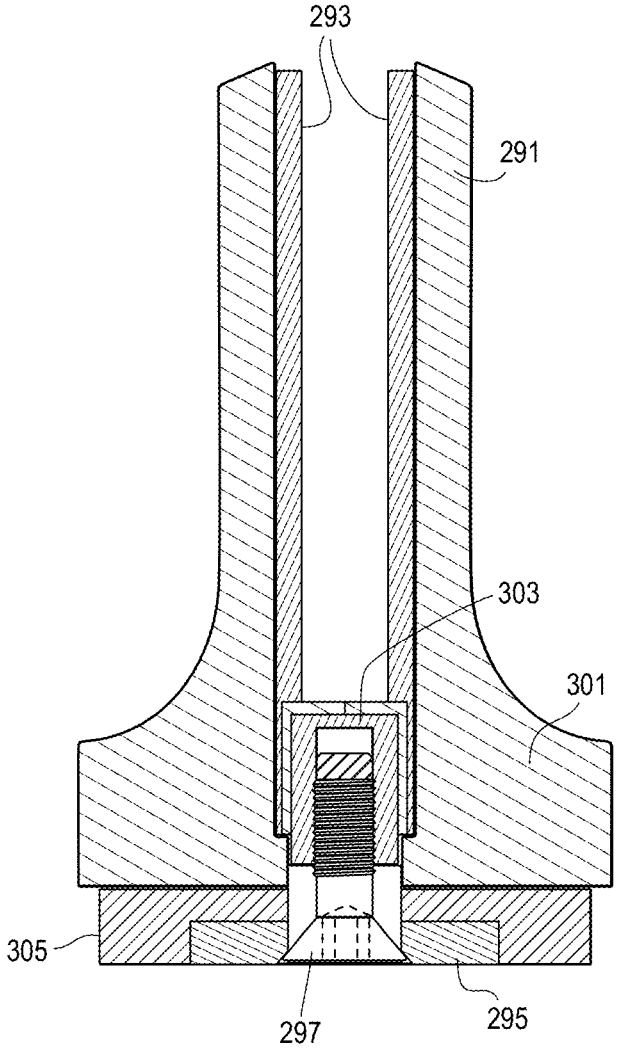

As shown in FIGS. 2A-F and 13A-D, various shelving arrangements 280, including one or more shelves, and/or screens may be coupled to the posts 22 of one of the leg assemblies. The shelving arrangements 280 may have a pair of supports 100 connected to the posts 22 as described above, e.g., with a clamping member, and include one or more cross members 284. The shelving arrangement may include one or more horizontal shelves 282, alone or in combination with a vertical screen 283, which may be configured with curved ends. As shown in FIG. 13A, a screen 286 may extend between and be supported by a pair of laterally spaced supports 100. Alternatively, as shown in FIG. 23A-23C, a screen 288 may be supported by a pair of support feet 290 secured to the posts 22, without any cross member. The support feet 290 include a pair of upstanding flanges 291, each of which may have an inner pad 293, or grippable material, which engages the screen 288. A base 301 of the support foot 290 includes a magnet 295 secured to a nut 303 disposed in the base 301. The base includes a stepped portion 305 received in the open top of the post 22, with the magnet 295 releasably engaging the plate 42 secured in the post 22, shown in FIG. 21.

As shown in FIGS. 2A-D, various monitors 300 may be coupled to the rear edges of the primary worksurfaces, for example with a base 302 secured over and/or on the rear edge, with the cutouts 76 and opening 80 providing space to install the base 302, which may be configured as or with a clamp.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A workstation comprising:

an understructure;

a primary worksurface supported by the understructure, wherein the primary worksurface comprises a front edge, a rear edge and opposite ends, wherein the front and rear edges are spaced apart in a first direction and wherein the ends are spaced apart in a second direction orthogonal to the first direction, wherein the primary worksurface is located at a first height adapted to accommodate a seated user positioned adjacent to and facing the front edge;

a support extending upwardly from the primary worksurface at a location closer to the front edge than the rear edge; and an auxiliary worksurface coupled to the support and vertically spaced from the primary worksurface, wherein the auxiliary worksurface comprises a first edge spaced apart from a second edge and a length, wherein the auxiliary worksurface is pivotable relative the primary worksurface between a use position, wherein the first edge extends in the second direction and wherein at least a portion of the first edge overlies the front edge of the primary worksurface, and a stored position, wherein the first edge extends in the first direction, wherein the auxiliary worksurface is located at a second height adapted to accommodate a standing user positioned adjacent to and facing the first edge when the auxiliary worksurface is in the use position.

2. The workstation of claim 1 wherein the auxiliary worksurface is pivotably mounted to the support about a vertical axis.

3. The workstation of claim 2 wherein the auxiliary worksurface is translatable relative to the vertical axis within a horizontal plane.

4. The workstation of claim 2 wherein the understructure comprises a post, wherein the support is mounted to the post.

5. The workstation of claim 4 wherein the end of the primary worksurface comprises a cutout shaped to mate with an outer profile of the post.

6. The workstation of claim 5 wherein the understructure comprises a pair of leg assemblies spaced apart in the second direction, wherein each of the leg assemblies comprises a pair of posts spaced apart in the first direction and at least one cross member connecting the pair of posts, and a pair of beams spaced apart in the first direction and extending in the second direction, wherein the beams are connected to the pair of leg assemblies, and wherein the primary worksurface comprises a pair of primary worksurfaces, each of the primary worksurfaces connected to one of the beams with the rear edges of the primary worksurfaces facing each other.

7. The workstation of claim 6 wherein the rear edges of the primary worksurfaces each comprise a cutout, wherein the cutouts define an opening between the rear edges of the primary worksurfaces.

8. The workstation of claim 6 wherein the understructure comprises four leg assemblies spaced apart in the second direction and connected with three pairs of beams, and wherein the primary worksurface comprises three pairs of primary worksurfaces connected to the three pairs of beams.

9. The workstation of claim 8 further comprising an end surface connected to one of the four leg assemblies adjacent an exposed one of the ends of one of the primary worksurfaces, wherein the end surface comprises a pair of cutouts shaped to mate with outer profiles of the pair of posts of the leg assembly connected thereto.

10. The workstation of claim 8 further comprising a shelf connected to the posts of one of the leg assemblies.

11. The workstation of claim 8 further comprising a screen connected to the posts of one of the leg assemblies.

12. The workstation of claim 1 wherein the support is disposed over the front edge of the primary worksurface.

13. A workstation comprising:

an understructure comprising "n1" leg assemblies spaced apart in a second direction and "n2" pairs of beams extending in the second direction and connecting the leg assemblies, wherein n2=n1−1;

"n3" primary worksurfaces supported by the understructure, wherein n3=2×n2, wherein each primary worksurface comprises a front edge, a rear edge and opposite ends, wherein the front and rear edges are spaced apart in a first direction orthogonal to the second direction, and wherein the ends are spaced apart in the second direction, wherein the primary worksurfaces are located at a first height adapted to accommodate a seated user positioned adjacent to and facing the front edge of each of the primary worksurfaces;

at least one support extending upwardly from at least one of the primary worksurfaces closer to the front edge than the rear edge of the at least one primary worksurface; and an auxiliary worksurface coupled to the support and vertically spaced from the at least one primary worksurface, wherein the auxiliary worksurface comprises a first edge spaced apart from a second edge and a length, wherein the auxiliary worksurface is pivotable relative to the at least one primary worksurface between a use position, wherein the first edge extends in the second direction, and a stored position, wherein the first edge extends in the first direction, wherein the auxiliary worksurface is located at a second height adapted to accommodate a standing user positioned adjacent to and facing the first edge when the auxiliary worksurface is in the use position.

14. The workstation of claim 13 wherein n1=4.

15. The workstation of claim 13 wherein the auxiliary worksurface is pivotably mounted to the support about a vertical axis.

16. The workstation of claim 15 wherein the auxiliary worksurface is translatable relative to the vertical axis within a horizontal plane.

17. The workstation of claim 13 wherein each of the leg assemblies comprises a pair of posts, wherein the support is mounted to one of the posts.

18. The workstation of claim 17 wherein each of the ends of each of the primary worksurfaces comprises a cutout shaped to mate with an outer profile of one of the posts.

19. The workstation of claim 17 further comprising a pair of end surfaces connected to endmost leg assemblies adjacent an exposed one of the ends of one of the primary worksurfaces, wherein the end surface comprises a pair of cutouts shaped to mate with outer profiles of the pair of posts of the leg assembly connected thereto.

20. The workstation of claim 17 further comprising a shelf connected to the posts of one of the leg assemblies.

21. The workstation of claim 17 further comprising a screen connected to the posts of one of the leg assemblies.

22. The workstation of claim 13 wherein the rear edges of the primary worksurfaces each comprise a cutout, wherein the cutouts define an opening between the rear edges of a pair of abutting primary worksurfaces.

23. The workstation of claim 13 wherein the support is disposed over the front edge of one of the primary worksurfaces.

* * * * *